US008603713B2

(12) United States Patent
Kotsugai et al.

(10) Patent No.: US 8,603,713 B2
(45) Date of Patent: Dec. 10, 2013

(54) TONER, AND DEVELOPER, TONER CARTRIDGE, IMAGE FORMING APPARATUS, PROCESS CARTRIDGE AND IMAGE FORMING METHOD USING THE SAME

(75) Inventors: Akihiro Kotsugai, Numazu (JP); Toyoshi Sawada, Hiratsuka (JP); Ryota Inoue, Mishima (JP); Akiyoshi Sabu, Numazu (JP); Shingo Sakashita, Numazu (JP); Keiko Osaka, Mishima (JP); Yukiko Nakajima, Numazu (JP)

(73) Assignee: Ricoh Company, Limited, Tokyo (JP)

( * ) Notice: Subject to any disclaimer, the term of this patent is extended or adjusted under 35 U.S.C. 154(b) by 733 days.

(21) Appl. No.: 12/713,833

(22) Filed: Feb. 26, 2010

(65) Prior Publication Data

US 2010/0216068 A1 Aug. 26, 2010

(30) Foreign Application Priority Data

Feb. 26, 2009 (JP) ..... 2009-044677
Dec. 15, 2009 (JP) ..... 2009-283964

(51) Int. Cl.
*G03G 9/087* (2006.01)

(52) U.S. Cl.
USPC ..... 430/109.4; 430/109.3; 430/105; 430/109.31; 430/124.1

(58) Field of Classification Search
USPC ..... 430/109.4, 105, 19.31
See application file for complete search history.

(56) References Cited

U.S. PATENT DOCUMENTS

| | | | | |
|---|---|---|---|---|
| 5,723,247 | A * | 3/1998 | Guistina et al. | 430/108.3 |
| 2007/0015077 | A1 * | 1/2007 | Yamashita et al. | 430/109.4 |
| 2007/0160782 | A1 * | 7/2007 | Yatsuzuka et al. | 428/34.2 |
| 2008/0227002 | A1 | 9/2008 | Moriya et al. | |
| 2009/0003885 | A1 | 1/2009 | Sabu et al. | |
| 2010/0221655 | A1 * | 9/2010 | Mukai et al. | 430/110.2 |

FOREIGN PATENT DOCUMENTS

| | | | |
|---|---|---|---|
| JP | 9-274335 | | 10/1997 |
| JP | 9-281746 | | 10/1997 |
| JP | 2909873 | | 4/1999 |
| JP | 2001-22123 | | 1/2001 |
| JP | 2004-93829 | | 3/2004 |
| JP | 3779221 | | 3/2006 |
| JP | 3785011 | | 3/2006 |
| JP | 2007-197602 | | 8/2007 |
| JP | 2009-58628 | | 3/2009 |
| JP | 2009-75544 | | 4/2009 |
| WO | WO 2007015516 | A1 * | 2/2007 |
| WO | WO 2010/001770 | A1 | 1/2010 |

OTHER PUBLICATIONS http://www.cem.msu.edu/~smithmr/Lactide.htm, 2012 Department of Chemistry, East Lansing, MI 48824.*

* cited by examiner

*Primary Examiner* — Mark F Huff
*Assistant Examiner* — Rashid Alam
(74) *Attorney, Agent, or Firm* — Oblon, Spivak, McClelland, Maier & Neustadt, L.L.P.

(57) ABSTRACT

A toner including a colorant, a thermoplastic resin (a) comprising an amorphous polyester resin having a main chain having a polyhydroxycarboxylic acid skeleton, and a thermoplastic resin (b) is provided. The toner is manufactured by a method including mixing the colorant with the thermoplastic resin (a) to prepare a preliminary mixture, and mixing the preliminary mixture with the thermoplastic resin (b).

9 Claims, 4 Drawing Sheets

TONER, AND DEVELOPER, TONER CARTRIDGE, IMAGE FORMING APPARATUS, PROCESS CARTRIDGE AND IMAGE FORMING METHOD USING THE SAME

BACKGROUND OF THE INVENTION

1. Field of the Invention

The present invention relates to a toner for use in electrophotographic image forming apparatuses such as a copier, an electrostatic printing, a printer, a facsimile machine, and an electrostatic recording. The present invention also relates to a developer, a toner cartridge, an image forming apparatus, a process cartridge, and image forming method using the toner.

2. Discussion of the Background

In electrophotographic image forming apparatus and electrostatic recording apparatus, an electric or magnetic latent image is developed into a toner image that is visible. For example, in electrophotography, an electrostatic latent image is formed on a photoreceptor and developed into a toner image with a toner. The toner image is transferred onto a recording medium such as paper and fixed thereon by heat, etc.

Generally, a toner comprises colored particles comprising a binder resin, a colorant, a charge controlling agent, etc. A toner is manufactured by various methods such as pulverization methods, suspension polymerization methods, dissolution suspension methods, emulsion aggregation methods, phase-transfer emulsification methods, and elongation polymerization methods.

Specific resins generally used for toner include thermoplastic resins such as styrene-acrylic resins, polyester resins, and polyol resins. In particular, polyester resins are widely used because of having a relatively large molecular weight and a high glass transition temperature while having a low softening point. Polyester resins also have high strength. Therefore, polyester resins are preferably used for toners which are required to be fixed at low temperatures (this property is hereinafter referred to as "low-temperature fixability"), such as toners for producing full-color images (hereinafter "full-color toners").

The coloring power and color reproducibility of a full-color toner depend on the dispersion state of a colorant in a binder resin. In a case in which the colorant is unevenly dispersed in the binder resin to make the toner opaque, the toner may not reliably reproduce the secondary colors. Therefore, it is preferable that the colorant is evenly dispersed in the binder resin to make the toner transparent.

Most organic pigments, such as azo pigments usable for yellow and magenta toners, generally have a hydrophilic chemical structure. Carbon blacks usable for black toners generally have an acid or basic polar group. Such pigments and carbon blacks are not always sufficiently dispersed in resins, depending on the properties thereof. It is generally known that to provide a polar group in a resin is effective for improving dispersibility of colorants therein. However, there is concern that the polar group may affect thermal and electric properties of the resultant toner.

Japanese Patent No. 2909873 discloses a toner including a lactic acid-based resin, one terminal group being hydroxyl group and the other terminal group being an alkyl ester of a carboxylic acid or a salt of a carboxylic acid. For example, a toner including a polylactic resin which is formed from L-lactide is disclosed therein. The toner may express low thermoplasticity when fixed because such a resin is crystalline and has a high melting point. As a result, the resultant image may have low transparency and low color saturation.

Japanese Patent Application Publication No. 09-274335 discloses a toner including a polyester resin obtained from dehydration polycondensation of a lactic acid and a tri- or higher functional oxycarboxylic acid. The tri- or higher functional polar group makes the resultant resin have a cross-linking structure. Therefore, the resultant resin may not melt quickly, resulting in poor transparency and color saturation.

Both Japanese Patent Nos. 3785011 and 3779221 disclose a toner including a polylactic-based biodegradable resin and a terpene phenol copolymer. Such a toner may not have sufficient low-temperature fixability and hot offset resistance at the same time.

SUMMARY OF THE INVENTION

Accordingly, an object of the present invention is to provide a toner having both high transparency and low-temperature fixability.

These and other objects of the present invention, either individually or in combinations thereof, as hereinafter will become more readily apparent can be attained by a toner, comprising:

a colorant;

a thermoplastic resin (a) comprising an amorphous polyester resin having a main chain having a polyhydroxycarboxylic acid skeleton; and a thermoplastic resin (b), wherein the toner is manufactured by a method comprising:

mixing the colorant with the thermoplastic resin (a) to prepare a preliminary mixture, and mixing the preliminary mixture with the thermoplastic resin (b); and a developer, a toner cartridge, an image forming apparatus, a process cartridge, and an image forming method using the above toner.

BRIEF DESCRIPTION OF THE DRAWINGS

These and other objects, features and advantages of the present invention will become apparent upon consideration of the following description of the preferred embodiments of the present invention taken in conjunction with the accompanying drawings, wherein.

DETAILED DESCRIPTION OF THE INVENTION

Figure 1:
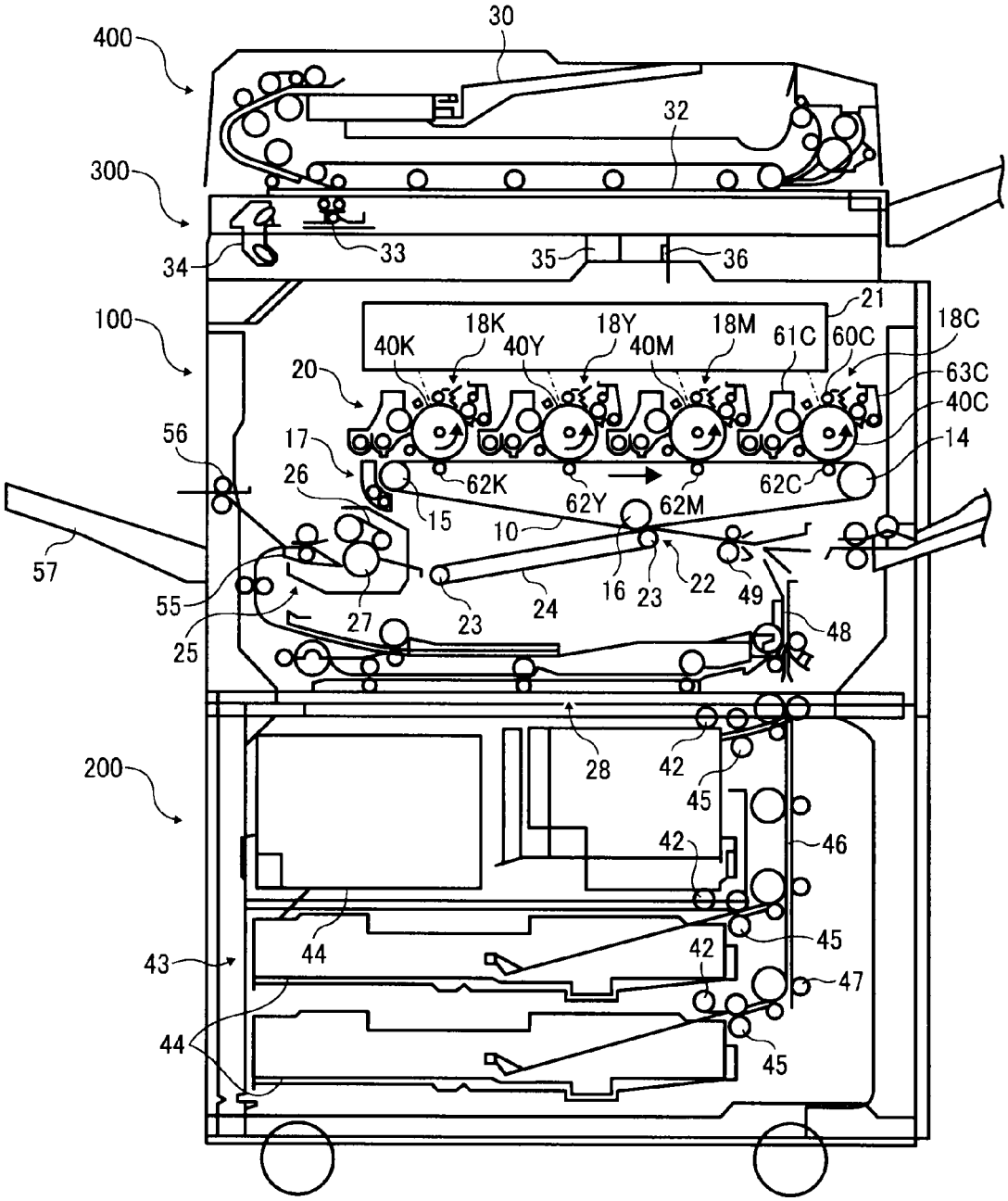
FIG. 1 is a schematic view illustrating an exemplary embodiment of the image forming apparatus of the present invention.

Generally, the present invention provides a toner comprising a colorant, a thermoplastic resin (a), and a thermoplastic resin (b). The toner is manufactured by mixing the colorant with the thermoplastic resin (a) first so that the colorant is sufficiently dispersed in the thermoplastic resin (a), and subsequently mixing the above-prepared mixture with the thermoplastic resin (b).

Preferably, the thermoplastic resin (a) is amorphous and highly transparent so that the resultant toner accurately reproduces colors. An exemplary embodiment of the thermoplastic resin (a) includes an amorphous polyester resin having a main chain having a polyhydroxycarboxylic acid skeleton. Such a resin can sufficiently disperse a colorant while having good fixability.

Specifically, the amorphous polyester resin may be a resin including a repeating unit comprised of a polycondensation product of a lactic acid and a hydroxyalkyl carboxylic acid. Such a resin has a main chain including ester groups at high concentrations and a side chain being a short alkyl group. Compared to polyester resins having a main chain including aromatic groups, which are conventionally used for toners, the above resin includes ester groups at higher concentrations per molecular weight and higher transparency when in amorphous state. Additionally, the above resin has high affinity for various colorants although including a small amount of functional groups such as organic acid groups (e.g., a carboxylic acid group) and hydroxyl group.

The polyhydroxycarboxylic acid skeleton includes a skeleton in which hydroxycarboxylic acids are polymerized or copolymerized. The polyhydroxycarboxylic acid skeleton is formed by directly subjecting a hydroxycarboxylic acid to a dehydration condensation or by subjecting the corresponding cyclic ester of a hydroxycarboxylic acid to a ring-opening polymerization. To more increase the molecular weight of the resultant polyhydroxycarboxylic acid, the ring-opening polymerization of the corresponding cyclic ester is more preferable. When a polyol having 2 or more valences is used as an initiator, the resultant resin has better affinity for colorants.

To obtain a toner having improved transparency and thermal properties, specific preferred examples of suitable monomers for forming the polyhydroxycarboxylic acid skeleton include, but are not limited to, aliphatic hydroxycarboxylic acids. More specifically, hydroxycarboxylic acids having 2 to 6 carbon atoms, such as lactic acid, glycolic acid, 3-hydroxybutyric acid, and 4-hydroxybutyric acid, are preferable. Among these acids, lactic acid is most preferable because the resultant resin have a proper glass transition temperature, transparency, and an affinity for colorants.

Other than hydroxycarboxylic acids, cyclic esters corresponding to the hydroxycarboxylic acids may also be used as monomers for forming the polyhydroxycarboxylic acid skeleton. In this case, the resultant resin has a polyhydroxycarboxylic acid skeleton in which the hydroxycarboxylic acid that forms the cyclic ester is polymerized. For example, when lactide is polymerized, the resultant resin has a polyhydroxycarboxylic acid skeleton in which lactic acid is polymerized.

Preferably, the above-described monomers have optical activity. When the thermoplastic resin (a) includes a polyhydroxycarboxylic acid skeleton formed from an optically-active monomer and the polyhydroxycarboxylic acid skeleton has an optical purity of 85% or less, preferably 60% or less, the thermoplastic resin (a) is amorphous and has good solvent-solubility and transparency. The optical purity (%) is represented by the following formula:

$$X(\%)=|X(\text{L-isomer})-X(\text{D-isomer})|$$

wherein X(L-isomer) and X(D-isomer) represent molar ratio (%) of L-isomer and D-isomer of the optically-active monomer, respectively.

The ratio between L-isomer and D-isomer in the resultant polyhydroxycarboxylic acid skeleton is equivalent to the ratio between L-isomer and D-isomer which actually reacted when forming the polyhydroxycarboxylic acid skeleton. Therefore, in order to control the optical purity X (%) of the thermoplastic resin (a), L-isomer and D-isomer may be appropriately used in combination to form a racemic body.

Specific examples of the optically-active monomer include, but are not limited to, lactic acid. Lactic acid is represented by the following formula:

$$HO—C^*H(CH_3)COOH$$

wherein C* represents an asymmetric carbon. Lactic acid includes both L-isomer and D-isomer.

When the optical purity of a lactic acid is 85% or less, preferably 60% or less, the resultant polylactic acid skeleton is substantially amorphous. Of course, a lactic acid may be polymerized in combination with other hydroxycarboxylic acids as described above. When a lactic acid is used in combination with another hydroxycarboxylic acid, the glass transition temperature of the resultant resin is generally reduced. In view of this, hydroxycarboxylic acids can be appropriately usable in combination with lactic acid so that the resultant toner is provided with desired thermal properties. Additionally, the polylactic acid resins may be copolymerized with resins having another skeleton without degrading crystallinity and transparency of the resultant resin. For example, polylactic acid resins may be copolymerized with diols, dicarboxylic acids, polyols (e.g., glycerin), hydroxy acids (e.g., glycolic acid), or polyhydroxycarboxylic acids (e.g., malic acid, tartaric acid).

At the time a resin having a polyhydroxycarboxylic acid skeleton is polymerized, an alcohol or a lactone can be used as a co-initiator. As the alcohol, polyols having 2 or more valences (e.g., 1,2-propanediol, 1,3-propanediol) are preferable from the viewpoint of thermal melting property of the resultant resin. As the lactone, ϵ-caprolactone is preferable from the viewpoint of thermal melting property of the resultant resin.

The thermoplastic resin (a) can be obtained by various methods. One exemplary method includes directly subjecting a mixture of monomers for forming a polyhydroxycarboxylic acid skeleton (e.g., lactic acid) and other components to a dehydration polymerization in the presence of a catalyst and an optional alcohol. Another exemplary method includes subjecting a lactide that is a dimer of a hydroxycarboxylic acid obtained by dehydration of the hydroxycarboxylic acid to a ring-opening polymerization. Yet another exemplary method includes synthesizing the resin using an esterification enzyme reaction of lipase.

To obtain an amorphous resin, monomers may include an appropriate amount of L-isomer and D-isomer to form a racemic body. For example, when the monomer includes a lactide, the lactide may be a mixture of L-lactide and D-lactide or a mixture of either one of L-isomer or D-isomer and meso-lactide. Alternatively, an amorphous resin may be obtained by ring-opening polymerization of meso-lactide.

The thermoplastic resin (a) is mixed with a colorant so that the colorant is sufficiently dispersed therein. The resultant mixture may be a colorant master batch. The colorant is dispersed in the thermoplastic resin (a) by, for example, heating, melting, and kneading the mixture; or dissolving the mixture in an organic liquid and applying a mechanical and fluidic shearing force thereto using media such as beads.

Specific examples of usable colorants include dyes and pigments such as carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, and lithopone. These materials can be used alone or in combination.

The toner may be a black toner, a cyan toner, a magenta toner, or a yellow toner, for example. Colorants are selected as appropriate according to a desired color of the resultant toner.

Specific examples of usable black colorants include, but are not limited to, carbon blacks (C. I. Pigment Black 7) such as furnace black, lampblack, acetylene black, and channel black; metals such as copper, iron (C. I. Pigment Black 11), and titanium oxide; and organic pigments such as aniline black (C. I. Pigment Black 1).

Specific examples of usable magenta colorants include, but are not limited to, C. I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 48:1, 49, 50, 51, 52, 53, 53:1, 54, 55, 57, 57:1, 58, 60, 63, 64, 68, 81, 83, 87, 88, 89, 90, 112, 114, 122, 123, 163, 177, 179, 202, 206, 207, 209, 211, 283, and 286; C. I. Pigment Violet 19; and C. I. Vat Red 1, 2, 10, 13, 15, 23, 29, and 35.

Specific examples of usable cyan colorants include, but are not limited to, C. I. Pigment Blue 2, 3, 15, 15:1, 15:2, 15:3, 15:4, 15:6, 16, 17, and 60; C. I. Vat Blue 6; C. I. Acid Blue 45; copper phthalocyanine pigments in which the phthalocyanine skeleton is substituted with 1 to 5 phthalimide methyl group; and Green 7 and 36.

Specific examples of usable yellow colorants include, but are not limited to, C. I. Pigment Yellow 0-16, 1, 2, 3, 4, 5, 6, 7, 10, 11, 12, 13, 14, 15, 16, 17, 23, 55, 65, 73, 74, 83, 97, 110, 151, 154, 155, 180, and 185; C. I. Vat Yellow 1, 3, and 20; and Orange 36.

The above colorants can be used alone or in combination.

The toner preferably includes a colorant in an amount of from 1 to 15% by weight, and more preferably from 3 to 10% by weight. When the amount of the colorant is too small, the toner may express weak coloring power. When the amount of the colorant is too large, the colorant may be unevenly dispersed in the toner, thereby causing deterioration of coloring power and electric properties.

The mixture of the thermoplastic resin (a) and a colorant is further mixed with the thermoplastic resin (b). The thermoplastic resin (b) preferably has thermal, electric, and optical properties which are generally required for toner. Specific examples of suitable resins for the thermoplastic resin (b) include, but are not limited to, thermoplastic resins such as styrene-acrylic resins, polyester resins, polyol resins, epoxy resins, phenol resins, polyurethane resins, petroleum resins, and olefin resins. Moreover, the thermoplastic resin (b) preferably has affinity for the thermoplastic resin (a) so as not to degrade transparency of the mixture.

The ratio of the thermoplastic resin (a) to the thermoplastic resin (b) is preferably from 10/90 to 70/30, but is not limited thereto. Within the above range, the resultant toner has good color reproducibility and transparency without degrading dispersibility of colorants.

An amorphous polyester resin having a polyhydroxycarboxylic acid skeleton, described above as an embodiment of the thermoplastic resin (a), is also usable as the thermoplastic resin (b). Amorphous resins are preferable from the viewpoint of transparency.

Such a resin may have an acidic group such as hydroxyl group, carboxylic acid group, and sulfonic acid group on its terminal end or an arbitrary portion. In particular, the acid value and hydroxyl value of a polyester resin having a polyhydroxycarboxylic acid skeleton can be controlled by modifying its terminal end.

Additionally, a resin partially having urethane bonds which is obtained by reacting an amorphous polyester resin having a polyhydroxycarboxylic acid skeleton with a compound having 2 or more isocyanate groups is also usable as the thermoplastic resin (b). As the compound having 2 or more isocyanate groups, isophorone diisocyanate (IPDI) is preferable.

The toner can be manufactured by various methods. One example method includes kneading the mixture of the thermoplastic resin (a) and a colorant with the thermoplastic resin (b) using a heating kneader, a roll kneader, or a single-axis or multiple-axis continuous kneader while applying heat, and pulverizing the resultant mixture into particles. Another example method includes dispersing the mixture of the thermoplastic resin (a) and a colorant and the thermoplastic resin (b) in a fluid medium (e.g., an aqueous medium) to form a dispersion containing particles thereof and aggregating or fusing the particles. Another example method includes dissolving the mixture of the thermoplastic resin (a) and a colorant and the thermoplastic resin (b) in styrene or a vinyl monomer and polymerizing them in a nonaqueous medium. Another example method includes dissolving the mixture of the thermoplastic resin (a) and a colorant and the thermoplastic resin (b) in a solvent, dispersing the solvent in an aqueous medium such as water to granulate, and removing the solvent. Another example method includes dissolving the mixture of the thermoplastic resin (a) and a colorant, the thermoplastic resin (b), and a precursor of the thermoplastic resin (b) in a solvent, dispersing the solvent in an aqueous medium such as water to granulate while subjecting the precursor of the thermoplastic resin (b) to a reaction to have a higher molecular weight, and removing the solvent.

Methods of manufacturing the toner are not limited to the above described methods.

The toner may include a charge controlling agent to provide the toner with appropriate charging ability, if needed.

A charge controlling agent may be included in the toner by being kneaded into a binder resin when the toner is obtained by a pulverization method, or dispersing or dissolving in solvent or monomer droplets when the toner is obtained by a chemical method. Alternatively, charge controlling agent particles which are dispersed in water may be aggregated into toner particles. Alternatively, a charge controlling agent may be chemically adducted to the surface of toner particles.

Suitable charge controlling agents are preferably colorless or whitish so as not to adversely affect the color tone of the resultant toner. Specific examples of suitable materials for the charge controlling agent include, but are not limited to, triphenylmethane dyes, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, and metal salts of salicylic acid derivatives. These materials can be used alone or in combination.

Specific examples of commercially available charge controlling agents include, but are not limited to, BONTRON® P-51 (quaternary ammonium salt), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE® PSY VP2038 (quaternary ammonium salt), COPY BLUE® PR (triphenyl methane derivative), COPY CHARGE® NEG VP2036 and COPY CHARGE® NX VP434 (quaternary ammonium salt), which are manufactured by Hoechst AG; LRA-901, and LR-147 (boron complex), which are manufactured by Japan Carlit Co., Ltd.; quinacridone and azo pigments; and polymers having a functional group such as a sulfonate group, a carboxyl group, and a quaternary ammonium group.

A charge controlling agent may be melt-kneaded with a master batch that is a mixture of the thermoplastic resin (a) and a colorant before dissolved or dispersed in a solvent, when the toner is manufactured by a chemical method, for example. Alternatively, a charge controlling agent may be directly dissolved or dispersed in a solvent along with other toner components. Alternatively, a charge controlling agent may be fixed on the surface of the resultant toner particles.

In particular, fixing a fluorine-containing quaternary ammonium salt on the surfaces of the resultant toner particles is a preferable method.

The content of the charge controlling agent is determined depending on the species of the binder resin used, and the toner manufacturing method (such as dispersion method) used, and is not particularly limited. However, the toner preferably includes a charge controlling agent in an amount of from 0.1 to 10 parts by weight, and more preferably from 0.2 to 5 parts by weight, based on 100 parts by weight of the binder resin. When the amount of the charge controlling agent is too small, the toner may have poor charge controllability. When the amount of the charge controlling agent is too large, the toner may have too large a charge quantity, thereby increasing an electric attracting force between a developing roller. As a result, the developer (i.e., the toner) may have poor fluidity and the resultant image may have low image density.

The toner may include a release agent, if needed. A release agent may be included in the toner by being kneaded into a binder resin when the toner is obtained by a pulverization method, or dispersing or dissolving in solvent or monomer droplets when the toner is obtained by a chemical method. Alternatively, release agent particles which are dispersed in water may be aggregated into toner particles. Alternatively, a release agent may be chemically adducted to the surface of toner particles.

Specific examples of suitable materials for the release agent include, but are not limited to, aliphatic hydrocarbon waxes (e.g., low-molecular-weight polyethylene, low-molecular-weight polypropylene, polyolefin wax, microcrystalline wax, paraffin wax, SAZOL wax), oxides and block copolymers of aliphatic hydrocarbon waxes (e.g., oxidized polyethylene), plant waxes (e.g., candelilla wax, carnauba wax, sumac wax, jojoba wax), animal waxes (e.g., bees wax, lanoline, spermaceti wax), mineral waxes (e.g., ozokerite, ceresin, petrolatum), waxes comprised primarily of fatty acid esters (e.g., montanic acid ester wax, castor wax), and partially or completely deoxidized fatty acid esters (e.g., deoxidized carnauba wax).

The materials described below are also suitable for the release agent: saturated straight-chain fatty acids (e.g., straight-chain alkylcarboxylic acids such as palmitic acid, stearic acid, and montanic acid); unsaturated fatty acids (e.g., brassidic acid, eleostearic acid, parinaric acid); saturated alcohols (e.g., long-chain alkyl alcohols such as stearyl alcohol, eicosyl alcohol, behenyl alcohol, carnaubyl alcohol, cetyl alcohol, myricyl alcohol); polyols (e.g., sorbitol); fatty acid amides (e.g., linoleamide, oleamide, lauramide); saturated fatty acid bisamides (e.g., methylene biscapramide, ethylene bislauramide, hexamethylene bisstearamide); unsaturated fatty acid amides (e.g., ethylene bisoleamide, hexamethylene bisoleamide, N,N'-dioleyl adipamide, N,N'-dioleyl sebacamide); aromatic bisamides (e.g., m-xylene bisstearamide, N,N-distearyl isophthalamide); metal salts of fatty acids (e.g., calcium stearate, calcium laurate, zinc stearate, magnesium stearate); aliphatic hydrocarbon waxes to which a vinyl monomer such as styrene and acrylic acid is grafted; partial ester compounds of fatty acids with polyols (e.g., behenic acid monoglyceride); and methyl ester compounds having hydroxyl group obtained by hydrogenating a vegetable oil.

The materials described below are also suitable for the release agent: a polyolefin which is obtained from a radical polymerization of an olefin under high pressures; a polyolefin which is obtained by purifying a low-molecular-weight byproduct of a polymerization of a high-molecular-weight polyolefin; a polyolefin which is polymerized in the presence of a catalyst (e.g., Ziegler catalyst, metallocene catalyst) under low pressures; a polyolefin which is polymerized using radical ray, electromagnetic ray, or light; a low-molecular-weight polyolefin obtained from thermal decomposition of a high-molecular-weight polyolefin; paraffin waxes; microcrystalline waxes; Fischer Tropsch waxes; synthesized hydrocarbon waxes synthesized by Synthol method, Hydrocoal method, or Arge method; a synthesized wax obtained from a monomer having 1 carbon atom; hydrocarbon waxes having a functional group such as hydroxyl group and carboxyl group; a mixture of a hydrocarbon wax and a hydrocarbon wax having a functional group; and the above waxes to which a vinyl monomer, such as styrene, a maleate, an acrylate, a methacrylate, a maleic anhydride, is grafted.

The above materials in which the molecular weight distribution is more narrowed by a press sweating method, a solvent method, a recrystallization method, a vacuum distillation method, a supercritical gas extraction method, or a solution crystallization method are also preferable. Additionally, low-molecular-weight solid fatty acids, low-molecular-weight solid alcohols, low-molecular-weight solid compounds, and other materials from which impurities are removed are also preferable.

When a toner is manufactured by a pulverization method, release agent is likely to expose at the surface of the resultant toner. This is because a kneaded toner components mixture is likely to fracture from interfaces between binder resin and release agent. Generally, the exposed release agent forms an undesired film thereof on a photoreceptor or a carrier. This phenomenon is hereinafter referred to as "filming". The toner of the present invention is unlikely to cause filming because the thermoplastic resin (b) has good affinity for release agents and therefore the release agents are unlikely to release from the toner. In particular, the thermoplastic resin (b) has excellent affinity for carnauba waxes. Both normal carnauba waxes and free fatty acid-free carnauba waxes are preferable.

To provide the toner with both fixability and offset resistance, the release agent preferably has a melting point of from 60 to 120° C., and more preferably from 70 to 110° C. When the melting point is too low, the toner may have poor blocking resistance. When the melting point is too high, the toner may have poor offset resistance.

When 2 or more release agents are used in combination, both plasticizing and releasing functions are expressed simultaneously. Specific examples of usable release agents having plasticizing function include low-melting-point waxes having a branched molecular structure or a polar group. Specific examples of usable release agents having releasing function include high-melting point waxes having a straight-chain molecular structure or no polar group. For example, a combination of 2 or more release agents, the difference in melting point among them is from 10 to 100° C., is preferable. Further, a combination of a polyolefin and a grafted polyolefin is also preferable.

When two release agents having a similar structure are used in combination, a release agent having a relatively low melting point expresses plasticizing function and another release agent having a relatively high melting point expresses releasing function. When the difference in melting point between the two release agents is from 10 to 100° C., plasticizing and releasing functions are separately expressed effectively. When the difference in melting point is too small, plasticizing and releasing functions may not be clearly separately expressed. When the difference in melting point is too large, either plasticizing or releasing functions may not be strengthened due to the interaction therebetween. To more clearly separate plasticizing and releasing functions, at least one release agent preferably has a melting point of from 60 to 120° C., more preferably from 70 to 110° C.

Release agents having a relatively branched structure or a polar group such as a functional group, or those modified with minor components are likely to express plasticizing function. Release agents having a relatively straight structure without any polar group or modification are likely to express releasing function. Preferable combinations are described below: a combination of a polyethylene homopolymer or copolymer comprised primarily of ethylene and an olefin other than ethylene; a combination of a polyolefin and a grafted polyolefin; a combination of an alcohol wax, a fatty acid wax, or an ester wax and a hydrocarbon wax; a combination of a Fischer Tropsch wax or a polyolefin wax and a paraffin wax or a microcrystalline wax; a combination of a Fischer Tropsch wax and a polyolefin wax; a combination of a paraffin wax and a microcrystalline wax; and a combination of a carnauba wax, a candelilla wax, a rice wax, or a montan wax and a hydrocarbon wax.

To provide the toner with both storage stability and fixability, the toner preferably has a maximum endothermic peak within a temperature range of from 60 to 120° C., more preferably from 70 to 110° C., in an endothermic curve measured by DSC.

In the present specification, the melting point is regarded as a temperature at which the top of the maximum endothermic peak exists in an endothermic curve measured by DSC. Preferably, the release agent has a melting point of from 60 to 120° C.

The endothermic curve can be obtained with a differential scanning calorimeter TA-60WS and DSC-60 (from Shimadzu Corporation) according to a method based on ASTM D341-82. In the present specification, the endothermic curve is obtained by heating a sample at a heating rate of 10° C./min after once heating and cooling the sample.

The toner preferably includes a release agent in an amount of from 0.2 to 30 parts by weight, more preferably from 1 to 15 parts by weight, and most preferably from 3 to 10 parts by weight, based on 100 parts by weight of binder resins.

The toner may include various external additives for controlling fluidity, chargeability, and electric properties. Specific examples of usable external additives include, but are not limited to, fine particles of silica, hydrophobized silica, metal salts of fatty acids (e.g., zinc stearate, aluminum stearate), metal oxides (e.g., titania, alumina, tin oxide, antimony oxide), hydrophobized metal oxides, and fluoropolymers. Among these materials, hydrophobized silica, titania, and hydrophobized titania are preferable.

Specific examples of commercially available fine particles of hydrophobized silica include, but are not limited to, HDK H2000, HDK H2000/4, HDK H2050EP, HVK 21, and KDK H 1303 (from Clariant Japan K. K.); and R972, R974, RX200, RY200, R202, R805, and R812 (from Nippon Aerosil Co., Ltd.). Specific examples of commercially available fine particles of hydrophobized titania include, but are not limited to, P-25 (from Nippon Aerosil Co., Ltd.); STT-30 and STT-65C-S (from Titan Kogyo K. K.); TAF-140 (from Fuji Titanium Industry Co., Ltd.); MT-150W, MT-500B, MT-600B, and MT-150A (from Tayca Corporation); T-805 (from Nippon Aerosil Co., Ltd.); STT-30A, and STT-65S-S (from Titan Kogyo K. K.); TAF-500T and TAF-1500T (from Fuji Titanium Industry Co., Ltd.); MT-100S and MT-100T (from Tayca Corporation); and IT-S (from Ishihara Sangyo Kaisha, Ltd.).

Fine particles of silica, titania, and alumina that are hydrophilic may be treated with a hydrophobizing agent to be hydrophobized.

Specific examples of usable hydrophobizing agents include, but are not limited to, silane coupling agents (e.g., methyltrimethoxysilane, methyltrimethoxysilane, octyltrimethoxysilane, dialkyl dihalogenated silane, trialkyl halogenated silane, alkyl trihalogenated silane, hexaalkyldisilazane), silylation agents, silane coupling agents having a fluorinated alkyl group, organic titanate coupling agents, aluminum coupling agents, silicone oils, and silicone varnishes.

Particulate inorganic materials which are treated with a silicone oil, upon application of heat, if needed, are also usable as the external additive.

Specific examples of usable particulate inorganic materials include, but are not limited to, silica, alumina, titanium oxide, barium titanate, magnesium titanate, calcium titanate, strontium titanate, iron oxide, copper oxide, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, and silicon nitride. Among these materials, silica and titanium oxide are preferable.

Specific example of usable silicone oils include, but are not limited to, dimethyl silicone oils, methylphenyl silicone oils, chlorophenyl silicone oils, methylhydrogen silicone oils, alkyl-modified silicone oils, fluorine-modified silicone oils, polyether-modified silicone oils, alcohol-modified silicone oils, amino-modified silicone oils, epoxy-modified silicone oils, epoxy-polyether-modified silicone oils, phenol-modified silicone oils, carboxyl-modified silicone oils, mercapto-modified silicone oils, acrylic- or methacrylic-modified silicone oils, and α-methylstyrene-modified silicone oils.

The particulate inorganic materials preferably have a primary average particle diameter of from 1 to 100 nm, and more preferably from 3 to 70 nm. When the primary average particle diameter is too small, the particulate inorganic materials may be buried in toner particles and may not express their function. When the primary average particle diameter is too large, the particulate inorganic materials may unevenly damage an electrostatic latent image bearing member.

The particulate inorganic materials may be used in combination with hydrophobized particulate inorganic materials. The hydrophobized particulate inorganic materials preferably have a primary average particle diameter of from 1 to 100 nm, and more preferably from 5 to 70 nm. For example, a combination of at least 2 kinds of hydrophobized particulate inorganic materials having a primary average particle diameter of 20 nm or less and 1 kind of hydrophobized particulate inorganic material having a primary average particle diameter of 30 nm or more is preferable. The particulate inorganic materials preferably have a BET specific surface area of from 20 to 500 $m^2/g$.

The toner may include the external additive in an amount of from 0.1 to 5% by weight, and preferably from 0.3 to 3% by weight.

Particulate resins are also usable as the external additive. Specific examples of usable materials for the particulate resins include, but are not limited to, polystyrenes which are obtained from soap-free emulsion polymerization, suspension polymerization, or dispersion polymerization; copolymers of methacrylates and/or acrylates; polycondensation resins such as silicone, benzoguanamine, and nylon; and thermosetting resins. Such particulate resins may improve chargeability of the toner. Therefore, generation of reversely-charged toner particles and the occurrence of background fouling in the resultant image may be prevented. The toner may include the particulate resin in an amount of from 0.01 to 5% by weight, and preferably from 0.1 to 2% by weight.

The toner may also include a fluidity improver, a cleanability improver, a magnetic material, a metal soap, etc.

The fluidity improver is a material capable of preventing deterioration of fluidity and chargeability of the toner even under high humidity conditions, and is obtained by hydrophobizing a suitable material with a surface treatment agent such as a silane coupling agent, a silylation agent, a silane coupling agent having a fluorinated alkyl group, an organic titanate coupling agent, an aluminum coupling agent, a silicone oil, and a modified silicone oil.

The cleanability improver is added to the toner so that residual toner particles remaining on an electrostatic latent image bearing member or an intermediate transfer member are easily removed. Specific examples of suitable materials for the cleanability improver include, but are not limited to, metal salts of fatty acids (e.g., zinc stearate, calcium stearate) and fine particles of polymers (e.g., polymethyl methacrylate, polystyrene) which are obtained by soap-free emulsion polymerization. The fine particles of polymers preferably have a narrow size distribution and a volume average particle diameter of from 0.01 to 1 μm.

Specific examples of usable magnetic materials include, but are not limited to, iron powders, magnetite, and ferrite. From the viewpoint of color tone, whitish materials are preferable.

The toner preferably has a weight average particle diameter of from 3 to 8 μm, more preferably from 4 to 7 μm, and most preferably from 5 to 6 μm. Within such a range, a latent image with micro dots can be accurately reproduced. When the weight average particle diameter is too small, the toner may have poor fluidity while having excellent dot reproducibility. When the weight average particle diameter is too large, dot reproducibility may be reduced.

The toner preferably includes toner particles with a particle diameter of 5 μm or less in an amount of from 60 to 90% by number, more preferably from 60 to 80% by number, and most preferably from 60 to 70% by number. Within such a range, high quality images with good granularity, sharpness, and thin line reproducibility can be produced because fine toner particles may smooth edges of an image. When the amount of toner particles with a particle diameter of 5 μm or less is too small, the resultant image quality may deteriorate. When the amount of toner particles with a particle diameter of 5 μm or less is too large, fluidity and transferability of the toner may deteriorate.

A size distribution of the toner may be represented by the ratio ($D_4$/Dn) of the weight average particle diameter ($D_4$) to the number average particle diameter (Dn). The size distribution ($D_4$/Dn) is preferably from 1.65 to 2.00, and more preferably from 1.70 to 1.90. When the toner includes small-size toner particles in a large amount, the resultant image quality may be good but fluidity and transferability of the toner may be poor. Therefore, the toner of the present invention preferably has an appropriately wide size distribution so as not to deteriorate fluidity and transferability.

The weight average particle diameter ($D_4$), the number average particle diameter (Dn), and the amount of toner particles with a particle diameter of 5 μm or less can be measured under the following conditions.

Measurement instrument: COULTER MULTISIZER III (from Beckman Coulter)

Aperture diameter: 100 μm

Analysis software: BECKMAN COULTER MULTISIZER 3 version 3.51 (from Beckman Coulter)

Electrolyte: ISOTON III (from Beckman Coulter)

Dispersion liquid: 10% Surfactant (an alkylbenzene sulfonate, NEOGEN SC-A from Dai-ichi Kogyo Seiyaku Co., Ltd.)

Dispersion condition: 10 mg of a sample is added to 5 mL of the dispersion liquid and dispersed for 1 minute with an ultrasonic disperser. 25 mL of the electrolyte is further added thereto and dispersed for 1 minute with an ultrasonic disperser.

Measurement condition: 100 mL of the electrolyte and the dispersion liquid are contained in a beaker so that 30,000 toner particles can be subjected to a measurement of particle diameter within 20 seconds. The weight average particle diameter ($D_4$), the number average particle diameter (Dn), and the amount of toner particles with a particle diameter of 5 μm or less are calculated from a size distribution obtained from the measurement results of 30,000 toner particles.

The developer of the present invention includes the toner of the present invention and other components such as a carrier. In particular, the developer may be either a one-component developer comprising a toner and no carrier or a two-component developer comprising a toner and a carrier. Two-component developers are more preferable for high-speed printers because of having long lifespan.

In the one-component developer of the present invention, advantageously, the average particle diameter of the toner does not vary very much upon consumption or supplement of toner particles. The toner is unlikely to cause filming on a developing roller or adhere to a toner layer controlling blade, providing reliable developability and image for an extended period of time.

In the two-component developer of the present invention, advantageously, the average particle diameter of the toner does not vary very much upon repeated consumption or supplement of toner particles for an extended period of time, providing reliable developability for an extended period of time.

A suitable carrier includes a core material and a resin layer that covers the core material.

The core material may be a manganese-strontium (Mn—Sr) or manganese-magnesium (Mn—Mg) material having a magnetization of from 50 to 90 emu/g, for example. To produce high-density images, the core material may be a high-magnetization material such as an iron powder having a magnetization of 100 emu/g or more or a magnetite having a magnetization of from 75 to 120 emu/g, for example. On the other hand, the core material may also be a low-magnetization material such as a copper-tin material having a magnetization of from 30 to 80 emu/g, for example. In this case, developer brushes that are formed on a developing roller may softly contact an electrostatic latent image bearing member with a little impact, resulting in high quality images. These core materials can be used alone or in combination.

The core material preferably has a volume average particle diameter $D_{50}$ of from 10 to 200 μm, and more preferably from 40 to 100 μm. When the volume average particle diameter is too small, the resultant carrier may include a very large amount of ultrafine particles. As a result, the magnetization per particle may decrease and carrier scattering may occur. When the volume average particle diameter is too large, the specific surface area of the resultant carrier may decrease and toner scattering may occur. In addition, solid images may not be reproduced faithfully.

Specific examples of usable resins for the resin layer include, but are not limited to, amino resins, polyvinyl resins, polystyrene resins, halogenated polyolefin resins, polyester resins, polycarbonate resins, polyethylene resins, polyvinyl fluoride resins, polyvinylidene fluoride resins, polytrifluoroethylene resins, polyhexafluoropropylene resins, copolymers of vinylidene fluoride and acrylic monomers, copolymers of vinylidene fluoride and vinyl fluoride, fluoroterpolymers (such as copolymers of tetrafluoroethylene, vinylidene fluoride, and monomers having no fluoro group), and silicone resins. These resins can be used alone or in combination. Among these resins, silicone resins are preferable.

Usable silicone resins include straight silicone resins consisting of organosiloxane bonds, and modified silicone resins modified with an alkyd resin, a polyester resin, an epoxy resin, an acrylic resin, a urethane resin, etc.

Specific examples of commercially available straight silicone resins include, but are not limited to, KR271, KR255, and KR152 (from Shin-Etsu Chemical Co., Ltd.); and SR2400, SR2406, and SR2410 (from Dow Corning Toray Co., Ltd.).

Specific examples of commercially available modified silicone resins include, but are not limited to, KR206 (alkyd-modified), KR5208 (acrylic-modified), ES1001N (epoxy-modified), and KR305 (urethane-modified) (from Shin-Etsu Chemical Co., Ltd.); and SR2115 (epoxy-modified) and SR2110 (alkyd-modified) (from Dow Corning Toray Co., Ltd.).

Silicone resins may be used alone or in combination with a cross-linking component or a charge controlling component.

The resin layer may include a conductive powder, if needed. Specific examples of usable conductive powders include, but are not limited to, powders of metals, carbon black, titanium oxide, tin oxide, and zinc oxide. The conductive powder preferably has an average particle diameter of 1 μm or less. When the average particle diameter is too large, it is difficult to control electric resistance of the resin layer.

The resin layer may be formed by applying an application liquid on the surface of the core material, followed by drying and baking. The application liquid includes a solvent in which a resin such as a silicone resin is dissolved. The application liquid may be applied by a dip application method, a spraying method, a brush application method, etc.

Specific examples of usable solvents for the application liquid include, but are not limited to, toluene, xylene, methyl ethyl ketone, methyl isobutyl ketone, cellosolve, and butyl acetate.

The baking may be performed by either external heating methods or internal heating methods such as methods using a fixed electric furnace, a fluid electric furnace, a rotary electric furnace, or a burner furnace, and methods using microwave.

The carrier preferably includes the resin layer in an amount of from 0.01 to 5.0% by weight. When the amount is too small, the resin layer may not be evenly formed on the surface of the core material. When the amount is too large, the carrier particles may coalesce with each other because the resin layer is too thick.

The two-component developer preferably includes the carrier in an amount of from 90 to 98% by weight, and more preferably from 93 to 97% by weight.

Alternatively, the two-component developer preferably includes 100 parts by weight of the carrier and 1 to 10.0 parts by weight of the toner.

The image forming method of the present invention includes a charging process in which a surface of an electrostatic latent image bearing member is charged; an exposure process in which the charged surface of the electrostatic latent image bearing member is exposed to light to form an electrostatic latent image thereon; a developing process in which the electrostatic latent image is developed into a toner image with the toner of the present invention; a transfer process in which the toner image is transferred onto a recording medium; and a fixing process in which the toner image is fixed on the recording medium.

The image forming apparatus of the present invention includes an electrostatic latent image bearing member; a charger configured to charge a surface of the electrostatic latent image bearing member; an irradiator configured to irradiate the charged surface of the electrostatic latent image bearing member with light to form an electrostatic latent image thereon; a developing device configured to develop the electrostatic latent image into a toner image with the toner of the present invention; a transfer device configured to transfer the toner image onto a recording medium; and a fixing device configured to fix the toner image on the recording medium. The image forming apparatus may optionally include a cleaning device configured to clean the surface of the electrostatic latent image bearing member after the toner image is transferred onto the recording medium.

FIG. 1 is a schematic view illustrating an exemplary embodiment of the image forming apparatus of the present invention. The image forming apparatus illustrated in FIG. 1 is an electrophotographic full-color copier which employs a tandem indirect transfer method.

Referring to FIG. 1, the image forming apparatus includes a main body 100, a paper feed table 200 provided below the main body 100, a scanner (a reading optical system) 300 provided above the main body 100, and an automatic document feeder (ADF) 400 provided above the scanner 300.

An intermediate transfer member 10 is provided roughly in the center of the main body 100. The intermediate transfer member 10 is a seamless belt stretched taut in the lateral direction. The intermediate transfer member 10 is stretched taut with support rollers 14, 15, and 16 and is rotatable clockwise. An intermediate transfer member cleaning device 17 for removing residual toner particles remaining on the intermediate transfer member 10 is provided on the left side of the support roller 15.

Image forming units 18K, 18Y, 18M, and 18C are tandemly arranged in this order along a part of the conveyance path of the intermediate transfer member 100 which is stretched taut between the support rollers 14 and 15. The image forming units 18K, 18Y, 18M, and 18C are configured to form images of black, yellow, magenta, and cyan, respectively, and compose a tandem image forming part 20. The arrangement order of the process cartridges is not limited to the above.

An irradiator 21 is provided above the tandem image forming part 20. A secondary transfer device 22 is provided on the opposite side of the tandem image forming part 20 relative to the intermediate transfer member 10. The secondary transfer device 22 includes a secondary transfer belt 24 that is a seamless belt stretched taut with two rollers 23. The secondary transfer belt 24 is pressed against the support roller 16 with the intermediate transfer member 10 therebetween so as to transfer a toner image from the intermediate transfer member 10 onto a sheet (e.g., paper).

A fixing device 25 is provided on the left side of the secondary transfer device 22. The fixing device 25 is configured to fix the toner image on the sheet. The fixing device 25 includes a fixing belt 26 that in the form of a seamless belt and a pressing roller 27 pressed against the fixing belt 26.

A sheet reversing device 28 is provided below the secondary transfer device 22 and the fixing device 25 nearly parallel to the tandem image forming part 20. The sheet reversing device 28 is configured to reverse a sheet when forming images on both sides of the sheet.

To make a full-color copy, a document may be set on a document table 30 of the automatic document feeder 400. Alternatively, a document may be set on a contact glass 32 of the scanner 300 while lifting up the automatic document feeder 400, and then the document is hold down by the automatic document feeder 400.

Upon pressing of a switch, not shown, in a case in which a document is set on the contact glass 32, the scanner 300 immediately starts driving so that a first runner 33 and a second runner 34 start moving. In a case in which a document is set on the document table 30, the scanner 300 starts driving after the document is fed onto the contact glass 32. The first runner 33 directs a light beam to the document, and reflects a reflected light beam from the document toward the second runner 34. A mirror in the second runner 34 reflects the reflected light beam toward an imaging lens 35. The light beam passed through the imaging lens 35 is then received by a reading sensor 36 and image information of black, yellow, magenta, and cyan is read.

On the other hand, upon pressing of the switch, at least one of the support rollers 14, 15, and 16 is driven to rotate by a driving motor, not shown, and the other support rollers are driven to rotate by the driving support roller so that the intermediate transfer member 10 rotatably conveys.

Simultaneously, photoreceptors 40K, 40Y, 40M, and 40C in the respective image forming units 18K, 18Y, 18M, and 18C start rotating so that single-color toner images of black, yellow, magenta, and cyan are formed on the photoreceptors 40K, 40Y, 40M, and 40C, respectively.

The black, yellow, magenta, and cyan toner images formed on the respective photoreceptors 40K, 40Y, 40M, and 40C are sequentially transferred onto the intermediate transfer member 10 and superimposed on one another so that a composite full-color toner image is formed.

On the other hand, upon pressing of the switch, one of paper feed rollers 42 starts rotating in the paper feed table 200 so that a sheet is fed from one of paper feed cassettes 44 in a paper bank 43. The sheet is separated by one of separation rollers 45 and fed to a paper feed path 46. Feed rollers 47 feed the sheet to a paper feed path 48 in the main body 100. The sheet is stopped by a registration roller 49. The registration roller 49 feeds the sheet to between the intermediate transfer member 10 and the secondary transfer device 22 in synchronization with an entry of the composite full-color toner image thereto. Thus, the composite full-color toner image (hereinafter the "toner image") is transferred onto the sheet.

The secondary transfer device 22 transfers the sheet having the toner image thereon to the fixing device 25. The toner image is fixed on the sheet by application of heat and pressure in the fixing device 25. The sheet on which the toner image is fixed is switched by a switch pick 55 so as to be discharged onto a discharge tray 57 by rotating a discharge roller 56. Alternatively, the sheet on which the toner image is fixed may be switched by the switch pick 55 so as to be fed to the sheet reversing device 28. In this case, the sheet may be fed to the transfer area again so that an image is formed on the back side of the sheet. The sheet having images on both sides thereof may be discharged onto the discharge tray 57 by rotating the discharge roller 56. The intermediate transfer member cleaning device 17 removes residual toner particles remaining on the intermediate transfer member 10 to prepare for a next image forming operation.

The image forming units 18K, 18Y, 18M, and 18C include respective photoreceptors 40K, 40Y, 40M, and 40C having a drum shape. Around the photoconductor 40C, a charger 60C, a developing device 61C, a primary transfer device 62C, a photoreceptor cleaning device 63C including a cleaning blade, and a neutralization device, not shown, are provided. The same are provided around the photoreceptors 40K, 40Y, and 40M as well.

For the sake of simplicity, the additional characters K, Y, M, and C representing colors of black, yellow, magenta, and cyan, respectively, may be hereinafter omitted.

Figure 2:
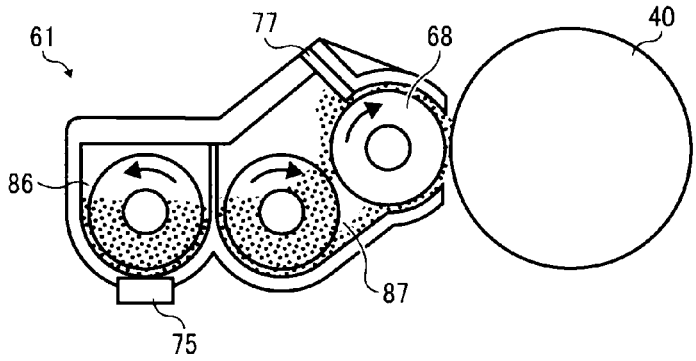
FIG. 2 is a schematic view illustrating the developing device in the image forming apparatus illustrated in FIG. 1.

FIG. 2 is a schematic view illustrating the developing device 61. The developing device 61 includes a first toner agitation chamber 86, a second toner agitation chamber 87, a developing sleeve 68, a toner concentration sensor 75, and a doctor blade 77. Toner particles are fed from a toner feeder, not shown, to the first toner agitation chamber 86 through a feed opening, not shown, provided on an outer wall of the first toner agitation chamber 86. In the first toner agitation chamber 86, the toner particles fed from the toner feeder and a two-component developer comprising magnetic particles and toner particles contained therein are agitated and conveyed with an agitation screw. In the second toner agitation chamber 87, the two-component developer comprising magnetic particles and toner particles contained therein are agitated and conveyed with a screw.

Figure 3:
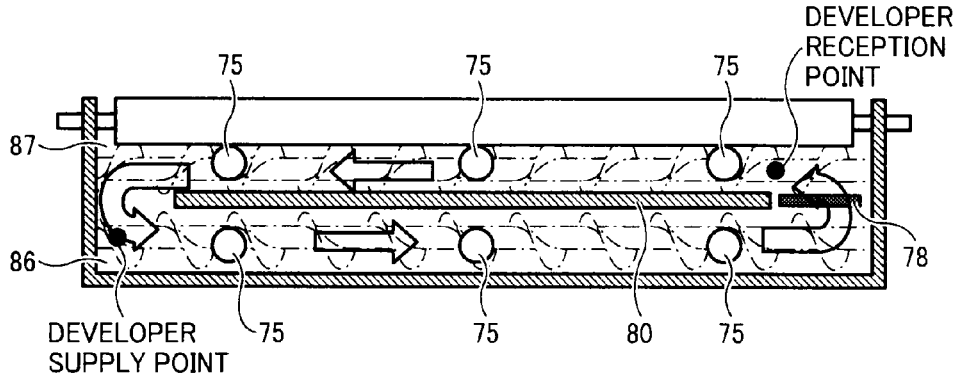
FIG. 3 is another schematic view illustrating the developing device in the image forming apparatus illustrated in FIG. 1.

FIG. 3 is another schematic view illustrating the developing device 61. As illustrated in FIG. 3, the first toner agitation chamber 86 and the second toner agitation chamber 87 are divided with a divider plate 80. The divider plate 80 has openings on both ends for supplying and receiving developer.

The developer in the second toner agitation chamber 87 is drawn up on the developing sleeve 68. The amount of the developer drawn up on the developing sleeve 68 is controlled by the doctor blade 77. The developer is then fed to a contact point of the developing sleeve 68 with the photoreceptor 40. The doctor blade 77 slidably contacts the developer with a large force.

Figure 4:
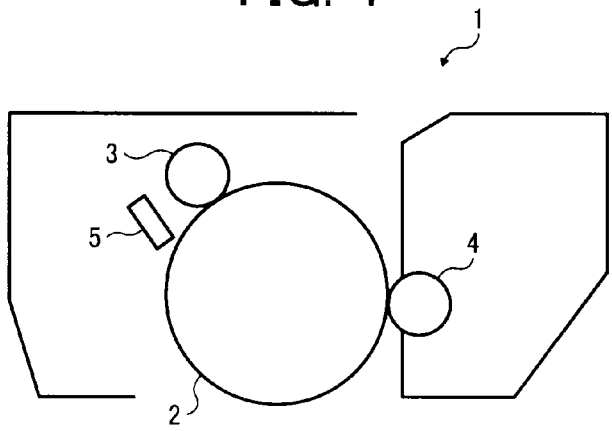
FIG. 4 is a schematic view illustrating an exemplary embodiment of the process cartridge of the present invention.

FIG. 4 is a schematic view illustrating an exemplary embodiment of the process cartridge of the present invention. A process cartridge 1 includes a photoreceptor 2, a charger 3, a developing device 4, and a cleaning device 5.

Exemplary embodiments of the process cartridge are not limited to the above. The process cartridge integrally supports 2 or more members (e.g., a photoreceptor 2, a charger 3, a developing device 4, a cleaning device 5) and is detachably mountable on image forming apparatuses such as a copier and a printer.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

In the descriptions in the following examples, "lactide" particularly represents "lactic acid lactide", unless otherwise specified.

Manufacturing Example of Thermoplastic Resin (a)-1

An autoclave reaction vessel equipped with a thermometer, a stirrer, and a nitrogen inlet pipe is charged with a toluene solution of 9 parts of L-lactide, 1 part of D-lactide, 0.08 parts of lauryl alcohol, and 0.002 parts of tin(II) octylate. The air in the vessel is vacuum-dried for 2 hours and substituted with nitrogen gas. The solution in the vessel is heated to 190° C. under nitrogen atmosphere to perform a ring-opening polymerization for 2 hours. The pressure in the vessel is reduced to 5 mmHg by deaeration with a vacuum pump while keeping the temperature of the reaction system, and the reaction system is left as it stands for 1 hour. The vessel is filled with nitrogen gas again and the resultant polymer is taken out. Thus, a thermoplastic resin (a)-1 is prepared.

Manufacturing Example of Thermoplastic Resin (a)-2

An autoclave reaction vessel equipped with a thermometer, a stirrer, and a nitrogen inlet pipe is charged with a toluene solution of 7 parts of L-lactide, 3 parts of meso-lactide, 0.08 parts of lauryl alcohol, and 0.002 parts of tin(II) octylate. The air in the vessel is vacuum-dried for 2 hours and substituted with nitrogen gas. The solution in the vessel is heated to 190° C. under nitrogen atmosphere to perform a ring-opening polymerization for 2 hours. The pressure in the vessel is reduced to 5 mmHg by deaeration with a vacuum pump while keeping the temperature of the reaction system, and the reaction system is left as it stands for 1 hour. The vessel is filled with nitrogen gas again and the resultant polymer is taken out. Thus, a thermoplastic resin (a)-2 is prepared.

Manufacturing Example of Thermoplastic Resin (a)-3

An autoclave reaction vessel equipped with a thermometer, a stirrer, and a nitrogen inlet pipe is charged with a toluene solution of 8 parts of L-lactide, 2 parts of D-lactide, 0.04 parts of 1,3-propanediol, and 0.002 parts of tin(II) octylate. The air in the vessel is vacuum-dried for 2 hours and substituted with nitrogen gas. The solution in the vessel is heated to 190° C. under nitrogen atmosphere to perform a ring-opening polymerization for 2 hours. The pressure in the vessel is reduced to 5 mmHg by deaeration with a vacuum pump while keeping the temperature of the reaction system, and the reaction system is left as it stands for 1 hour. The vessel is filled with nitrogen gas again and the resultant polymer is taken out. Thus, a thermoplastic resin (a)-3 is prepared.

Manufacturing Example of Thermoplastic Resin (a)-4

An autoclave reaction vessel equipped with a thermometer, a stirrer, and a nitrogen inlet pipe is charged with a toluene solution of 7 parts of L-lactide, 2.8 parts of meso-lactide, 0.2 parts of ϵ-caprolactone, 0.04 parts of lauryl alcohol, and 0.002 parts of tin(II) octylate. The air in the vessel is vacuum-dried for 2 hours and substituted with nitrogen gas. The solution in the vessel is heated to 190° C. under nitrogen atmosphere to perform a ring-opening polymerization for 2 hours. The pressure in the vessel is reduced to 5 mmHg by deaeration with a vacuum pump while keeping the temperature of the reaction system, and the reaction system is left as it stands for 1 hour. The vessel is filled with nitrogen gas again and the resultant polymer is taken out. Thus, a thermoplastic resin (a)-4 is prepared.

Manufacturing Example of Thermoplastic Resin (a)-5

An autoclave reaction vessel equipped with a thermometer, a stirrer, and a nitrogen inlet pipe is charged with a toluene solution of 10 parts of ethylene oxide 2 mol adduct of bisphenol A, 8 parts of terephthalic acid, 2 parts of adipic acid, and 0.006 parts of tin(II) octylate. The solution is subjected to a reaction for 15 hours at 200° C. and 8 kPa. Thus, a thermoplastic resin (a)-5 is prepared.

Manufacturing Example of Thermoplastic Resin (b)-1

An autoclave reaction vessel equipped with a thermometer, a stirrer, and a nitrogen inlet pipe is charged with 8 parts of L-lactide and 2 parts of D-lactide. The air in the vessel is vacuum-dried for 2 hours and substituted with nitrogen gas. A toluene solution of 0.04 parts of 1,3-propanediol and 0.002 parts of tin(II) octylate is added to the vessel under nitrogen atmosphere at normal pressure. The solution in the vessel is heated to 140° C. to perform a ring-opening polymerization for 2 hours. The pressure in the vessel is reduced to 5 mmHg by deaeration with a vacuum pump while keeping the temperature of the reaction system, and the reaction system is left as it stands for 2 hours. The vessel is filled with nitrogen gas again and the resultant polymer is taken out.

Another autoclave reaction vessel equipped with a thermometer, a stirrer, and a nitrogen inlet pipe is charged with a toluene solution of 10 parts of ethylene oxide 2 mol adduct of bisphenol A, 10 parts of terephthalic acid, and 0.006 parts of tin(II) octylate. The solution is subjected to a reaction for 15 hours at 200° C. and 8 kPa. The vessel is returned to normal temperature and pressure and is filled with nitrogen gas again. The resultant polyester diol is taken out.

The polymer and the polyester diol prepared above are dissolved in methyl ethyl ketone, and isophorone diisocyanate (IPDI), i.e., an elongation agent, is further added thereto. The mixture is subjected to an elongation reaction for 6 hours at 50° C. Thus, a thermoplastic (polyester) resin (b)-1 is prepared.

Manufacturing Example of Thermoplastic Resin (b)-2

An autoclave reaction vessel equipped with a thermometer, a stirrer, and a nitrogen inlet pipe is charged with a toluene solution of 10 parts of ethylene oxide 2 mol adduct of bisphenol A, 8 parts of terephthalic acid, 2 parts of adipic acid, and 0.006 parts of tin(II) octylate. The solution is subjected to a reaction for 15 hours at 200° C. and 8 kPa to prepare a polyester diol. Further, 1 part of trimellitic anhydride is added to the vessel and the mixture is subjected to a reaction for 5 hours at 200° C. and 8 kPa. Thus, a thermoplastic (polyester) resin (b)-2 is prepared.

Preparation of Cyan Master Batch (a)-1C

First, 100 parts of the thermoplastic resin (a)-1, 100 parts of a cyan pigment (C. I. Pigment Blue 15:3), and 50 parts of pure water are mixed with a HENSCHEL MIXER. The mixture is kneaded for 30 minutes with a double roll kneader at a surface temperature of 80° C. Thus, a cyan master batch (a)-1C is prepared.

Preparation of Magenta Master Batch (a)-1M

The procedure for preparation of the cyan master batch (a)-1C is repeated except for replacing the cyan pigment with a magenta pigment (C. I. Pigment Red 286). Thus, a magenta master batch (a)-1M is prepared.

Preparation of Yellow Master Batch (a)-1Y

The procedure for preparation of the cyan master batch (a)-1C is repeated except for replacing the cyan pigment with a yellow pigment (C. I. Pigment Yellow 185). Thus, a yellow master batch (a)-1Y is prepared.

Preparation of Black Master Batch (a)-1K

The procedure for preparation of the cyan master batch (a)-1C is repeated except for replacing the cyan pigment with a black pigment (carbon black). Thus, a black master batch (a)-1K is prepared.

Preparation of Master Batches (a)-2C, 2M, 2Y and 2K to (a)-5C, 5M, 5Y and 5K

The procedure for preparation of the cyan master batch (a)-1C is repeated except for replacing the thermoplastic resin (a)-1 with the thermoplastic resin (a)-2, (a)-3, (a)-4 or (a)-5 and replacing the cyan pigment with the magenta, yellow or black pigment. Thus, master batches (a)-2C, 2M, 2Y and 2K, (a)-3C, 3M, 3Y and 3K, (a)-4C, 4M, 4Y and 4K, and (a)-5C, 5M, 5Y and 5K are prepared.

Examples 1 to 32 and Comparative Examples 1 to 8

Preparation of Toners 1 to 40

Toner components (i.e., mater batch, resin, release agent, charge controlling agent) described in Table 1 are preliminary mixed with a HENSHEL MIXER FM10B (from Mitsui Mining Co., Ltd.). The mixture is kneaded with a TWIN SCREW EXTRUDER PCM-30 (from Ikegai Co., Ltd.) at 100 to 130° C. The kneaded mixture is cooled to room temperature and pulverized into coarse particles having a diameter of 200 to 400 μm with a hammer mill. The coarse particles are pulverized into fine particles with an ultrasonic jet pulverizer LABO JET (from Nippon Pneumatic Mfg. Co., Ltd.). The fine particles are classified by size with an airflow classifier MDS-I (from Nippon Pneumatic Mfg. Co., Ltd.) to obtain a mother toner. Finally, 100 parts of the mother toner are mixed with 1.0 part of an external additive (HDK-2000 from Clariant Japan K. K.) with a HENSCHEL MIXER.

Toners 1 to 40 are prepared as described above. The compositions of the toners 1 to 40 are described in Table 1.

TABLE 1

| | Master Batch | | Resin | | Release Agent | | Charge Controlling Agent | |
|---|---|---|---|---|---|---|---|---|
| Toner No. | Species | Quantity (parts) | Species | Quantity (parts) | Species | Quantity (parts) | Species | Quantity (parts) |
| 1 | (a)-1M | 18 | (b)-1 | 82 | Carnauba wax | 7 | Zinc salicylate | 2 |
| 2 | (a)-2M | 18 | (b)-1 | 82 | " | 7 | " | 2 |
| 3 | (a)-3M | 18 | (b)-1 | 82 | " | 7 | " | 2 |
| 4 | (a)-4M | 18 | (b)-1 | 82 | " | 7 | " | 2 |
| 5 | (a)-5M | 18 | (b)-1 | 82 | " | 7 | " | 2 |
| 6 | (a)-1C | 18 | (b)-1 | 82 | " | 7 | " | 2 |
| 7 | (a)-2C | 18 | (b)-1 | 82 | " | 7 | " | 2 |
| 8 | (a)-3C | 18 | (b)-1 | 82 | " | 7 | " | 2 |
| 9 | (a)-4C | 18 | (b)-1 | 82 | " | 7 | " | 2 |
| 10 | (a)-5C | 18 | (b)-1 | 82 | " | 7 | " | 2 |
| 11 | (a)-1Y | 20 | (b)-1 | 80 | " | 7 | " | 2 |
| 12 | (a)-2Y | 20 | (b)-1 | 80 | " | 7 | " | 2 |
| 13 | (a)-3Y | 20 | (b)-1 | 80 | " | 7 | " | 2 |
| 14 | (a)-4Y | 20 | (b)-1 | 80 | " | 7 | " | 2 |
| 15 | (a)-5Y | 20 | (b)-1 | 80 | " | 7 | " | 2 |
| 16 | (a)-1K | 12 | (b)-1 | 88 | " | 7 | " | 2 |
| 17 | (a)-2K | 12 | (b)-1 | 88 | " | 7 | " | 2 |
| 18 | (a)-3K | 12 | (b)-1 | 88 | " | 7 | " | 2 |
| 19 | (a)-4K | 12 | (b)-1 | 88 | " | 7 | " | 2 |
| 20 | (a)-5K | 12 | (b)-1 | 88 | " | 7 | " | 2 |
| 21 | (a)-1M | 18 | (b)-2 | 82 | " | 7 | " | 2 |
| 22 | (a)-2M | 18 | (b)-2 | 82 | " | 7 | " | 2 |
| 23 | (a)-3M | 18 | (b)-2 | 82 | " | 7 | " | 2 |
| 24 | (a)-4M | 18 | (b)-2 | 82 | " | 7 | " | 2 |
| 25 | (a)-5M | 18 | (b)-2 | 82 | " | 7 | " | 2 |
| 26 | (a)-1C | 18 | (b)-2 | 82 | " | 7 | " | 2 |
| 27 | (a)-2C | 18 | (b)-2 | 82 | " | 7 | " | 2 |
| 28 | (a)-3C | 18 | (b)-2 | 82 | " | 7 | " | 2 |
| 29 | (a)-4C | 18 | (b)-2 | 82 | " | 7 | " | 2 |
| 30 | (a)-5C | 18 | (b)-2 | 82 | " | 7 | " | 2 |
| 31 | (a)-1Y | 20 | (b)-2 | 80 | " | 7 | " | 2 |
| 32 | (a)-2Y | 20 | (b)-2 | 80 | " | 7 | " | 2 |
| 33 | (a)-3Y | 20 | (b)-2 | 80 | " | 7 | " | 2 |
| 34 | (a)-4Y | 20 | (b)-2 | 80 | " | 7 | " | 2 |
| 35 | (a)-5Y | 20 | (b)-2 | 80 | " | 7 | " | 2 |
| 36 | (a)-1K | 12 | (b)-2 | 88 | " | 7 | " | 2 |
| 37 | (a)-2K | 12 | (b)-2 | 88 | " | 7 | " | 2 |
| 38 | (a)-3K | 12 | (b)-2 | 88 | " | 7 | " | 2 |

TABLE 1-continued

| Toner No. | Master Batch Species | Master Batch Quantity (parts) | Resin Species | Resin Quantity (parts) | Release Agent Species | Release Agent Quantity (parts) | Charge Controlling Agent Species | Charge Controlling Agent Quantity (parts) |
|---|---|---|---|---|---|---|---|---|
| 39 | (a)-4K | 12 | (b)-2 | 88 | " | 7 | " | 2 |
| 40 | (a)-5K | 12 | (b)-2 | 88 | " | 7 | " | 2 |

Preparation of Carrier

To prepare a resin layer coating liquid, 100 parts of a silicone resin (methyl silicone), 5 parts of γ-(2-aminoethyl) aminopropyltrimethoxysilane, and 10 parts of a carbon black are mixed for 20 minutes with a HOMO MIXER. The resin layer coating liquid is coated on the surface of a spherical ferrite having a volume average particle diameter of 35 μm in an amount of 1,000 parts using a fluidized bed coater. Thus, a carrier is prepared.

Preparation of Developers

Each of the toners 1 to 40 in an amount of 7 parts is mixed with the carrier in an amount of 93 parts. Thus, Example Developers 1 to 32 and Comparative Example Developers 1 to 8 are prepared.

Evaluations

Each of the Developers is subjected to the evaluations (1) to (3) described in detail below.

Figure 5:
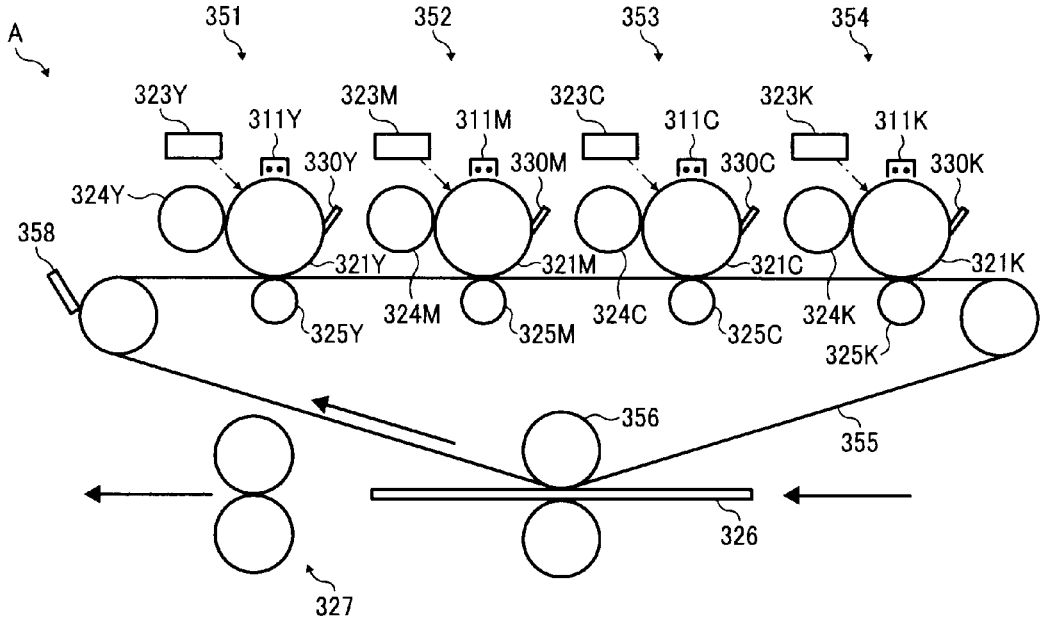
FIG. 5 is a schematic view illustrating an image forming apparatus used for the evaluations.

FIG. 5 is a schematic view illustrating an image forming apparatus A used for the evaluations (1) to (3). The image forming apparatus A is a tandem image forming apparatus which employs a non-contact charging method, a two-component developing method, a secondary transfer method, a blade cleaning method, an external heating roller fixing method, and an indirect transfer method.

Referring to FIG. 5, an image forming unit 351 includes a photoreceptor 321Y. Around the photoreceptor 321Y, a charger 311Y, an irradiator 323Y, a developing device 324Y, a primary transfer device 325Y, and a cleaning device 330Y are provided. The photoreceptor 321Y is charged by the charger 311Y and is irradiated with light emitted from the irradiator 323Y while rotating so that an electrostatic latent image is formed thereon. The developing device 324Y develops the electrostatic latent image into a yellow toner image with a yellow toner. The yellow toner image is transferred from the photoreceptor 321Y onto an intermediate transfer belt 355 by the primary transfer device 325Y. Residual yellow toner particles remaining on the photoreceptor 321Y are removed by the cleaning device 330Y.

Since image forming units 352, 353 and 354 that form magenta, cyan and black toner images, respectively, have a similar configuration to the image forming unit 351 that forms yellow toner image, the same reference numbers are given to identical constituent elements having the same functions and redundant descriptions thereof are omitted. The additional characters K, C, M, and Y representing toner colors of black, cyan, magenta, and yellow, respectively, are added or omitted as appropriate.

The image forming units 352, 353 and 354 form magenta, cyan and black toner images, respectively, on the intermediate transfer belt 355, respectively, in the same manner. A composite full-color toner image in which the yellow, magenta, cyan and black toner images are superimposed on one another is transferred onto a recording medium 326 by a transfer device 356. Residual toner particles remaining on the intermediate transfer belt 355 are removed by an intermediate transfer belt cleaning device 358. The composite full-color image is fixed on the recording medium 326 in a fixing device 327.

Figure 6:
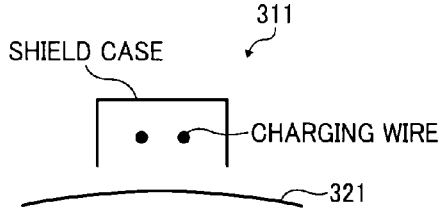
FIG. 6 is a schematic view illustrating the charger in the image forming apparatus illustrated in FIG. 5.

FIG. 6 is a schematic view illustrating the charger 311 that is a non-contact corona charger.

Figure 7:
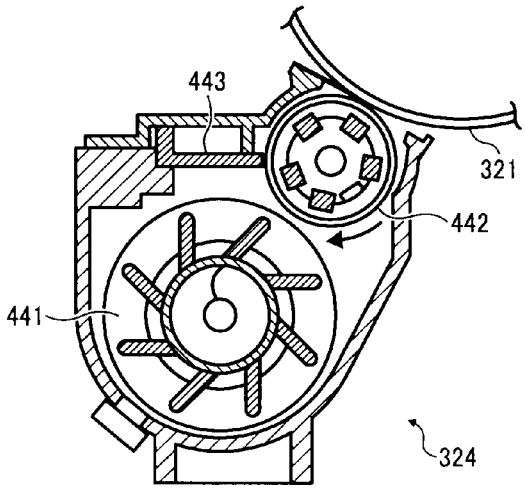
FIG. 7 is a schematic view illustrating the developing device in the image forming apparatus illustrated in FIG. 5.

FIG. 7 is a schematic view illustrating the developing device 324 that employs a two-component developing method. In the developing device 342, a screw 441 agitates and feeds a two-component developer to a developing sleeve 442 that serves as a developer bearing member. A doctor blade 443 that serves as a layer thickness control member controls the two-component developer to be fed to the developing sleeve 442. The amount of the two-component developer fed to the developing sleeve depends on a doctor gap that is formed between the doctor blade 443 and the developing sleeve 442.

Figure 8:
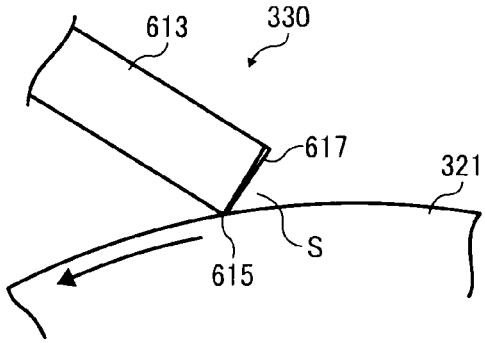
FIG. 8 is a schematic view illustrating the cleaning device in the image forming apparatus illustrated in FIG. 5.

FIG. 8 is a schematic view illustrating the cleaning device 330 that employs a cleaning blade 613. The cleaning blade 613 is provided with a toner prevention surface 617 that forms a space S between the photoreceptor 321. The space S is open from a contact point 615 of the cleaning blade 613 with the photoreceptor 321 toward an upstream side relative to the direction of rotation of the photoreceptor 321. In the present embodiment, the toner prevention surface 617 extends from the contact point 615 toward an upstream side relative to the direction of rotation of the photoreceptor 321 so that the space S takes the form of an acute angle.

Figure 9:
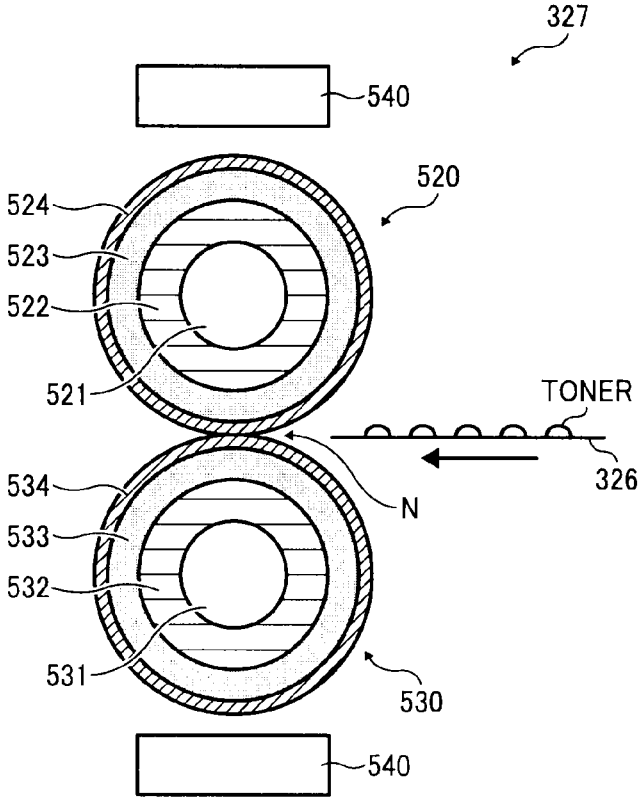
FIG. 9 is a schematic view illustrating the fixing device in the image forming apparatus illustrated in FIG. 5.

FIG. 9 is a schematic view illustrating the fixing device 327 that employs an electromagnetic induction heating method and a roller fixing method.

The fixing device 327 includes a fixing roller 520, a pressing roller 530 provided in contact with the fixing roller 520, and electromagnetic induction heat sources 540 that externally heat the fixing roller 520 and the pressing roller 530.

The fixing roller 520 includes, in order from an innermost side thereof, a core metal 521, a heat insulation elastic layer 522, a heat generation layer 523, and a release layer 524. The pressing roller 530 includes, in order from an innermost side thereof, a core metal 531, a heat insulation elastic layer 532, a heat generation layer 533, and a release layer 534. The release layers 524 and 534 are formed of a tetrafluoroethylene-perfluoroalkyl vinyl ether (PFA).

The pressing roller 530 is pressed against the fixing roller 520 by a spring, not shown, while both the rollers 530 and 520 being rotatable and forming a nip N therebetween.

The electromagnetic induction heat sources 540 are provided adjacent to the fixing roller 520 and the pressing roller 530 so that the heat generation layers 523 and 533 are heated by electromagnetic induction.

(1) Low-Temperature Fixability

A solid image including 0.85±0.1 mg/cm$^2$ of a toner is formed on plural sheets of a thick transfer paper <135> (from NBS Ricoh) in the image forming apparatus A. The solid image is formed on each sheet 3-cm behind the leading end thereof and fixed thereon while varying the fixing temperature. The fixed solid images are subjected to a drawing test using a drawing tester AD-401 (from Ueshima Seisakusho Co., Ltd.). In the drawing test, the surface of the solid image is drawn with a ruby needle (having a tip diameter of 260 to 320 μm and a tip angle of 60 degrees) while applying a load of 50 g. Subsequently, the surface of the solid image is strongly rubbed with a fabric HONECOTTO #440 (from Sakata Inx Eng. Co., Ltd.) for 5 times.

The minimum fixable temperature is defined as a temperature below which the image is abraded in the drawing test. Low-temperature fixability is graded into 5 levels as follows according to the minimum fixable temperature.

A: The minimum fixable temperature is 125° C. or less.

B: The minimum fixable temperature is from 126° C. to 135° C.

C: The minimum fixable temperature is from 136° C. to 145° C.

D: The minimum fixable temperature is from 146° C. to 155° C.

E: The minimum fixable temperature is 156° C. or more.

(2) Hot Offset Resistance

A solid image including 0.85±0.1 mg/cm$^2$ of a toner is formed on plural sheets of a normal transfer paper TYPE 6200 (from Ricoh Co., Ltd.) in the image forming apparatus A. The solid image is formed on each sheet 3-cm behind the leading end thereof and fixed thereon while varying the fixing temperature. The fixed solid images are visually observed to determine whether hot offset occurs or not.

The maximum fixable temperature is defined as a temperature above which hot offset occurs. Hot offset resistance is graded into 5 levels as follows according to the maximum fixable temperature.

A: The maximum fixable temperature is 230° C. or more.

B: The maximum fixable temperature is 210° C. or more and less than 230° C.

C: The maximum fixable temperature is 190° C. or more and less than 210° C.

D: The maximum fixable temperature is 180° C. or more and less than 190° C.

E: The maximum fixable temperature is less than 180° C.

(3) Haze

A solid image including 0.85±0.1 mg/cm$^2$ of a toner is formed on plural sheets of an OHP sheet TYPE PPC-DX (from Ricoh Co., Ltd.) in the image forming apparatus A. The solid image is fixed on the OHP sheet while setting the temperature of the fixing belt to 160° C. The fixed solid images are subjected to a measurement of haze (%), which represents transparency of toner, using a haze meter HGM-2DP (from Suga Test Instruments Co., Ltd.). The smaller the haze, the higher the transparency. Haze is graded into 3 levels as follows.

A: less than 20%

B: 20% or more and less than 30%

C: 30% or more

The evaluation results are shown in Table 2.

TABLE 2

| | Toner No. | Evaluation Results (1) Low-temperature Fixability | (2) Hot Offset Resistance | (3) Haze |
|---|---|---|---|---|
| Example 1 | 1 | B | B | A (15%) |
| Example 2 | 2 | B | B | A (14%) |
| Example 3 | 3 | A | C | A (16%) |
| Example 4 | 4 | A | B | A (17%) |
| Comparative Example 1 | 5 | D | B | B (23%) |

TABLE 2-continued

| | Toner No. | Evaluation Results (1) Low-temperature Fixability | (2) Hot Offset Resistance | (3) Haze |
|---|---|---|---|---|
| Example 5 | 6 | B | B | A (14%) |
| Example 6 | 7 | B | B | A (16%) |
| Example 7 | 8 | A | C | A (14%) |
| Example 8 | 9 | A | B | A (15%) |
| Comparative Example 2 | 10 | D | B | B (27%) |
| Example 9 | 11 | B | B | A (11%) |
| Example 10 | 12 | B | B | A (13%) |
| Example 11 | 13 | A | C | A (12%) |
| Example 12 | 14 | A | B | A (16%) |
| Comparative Example 3 | 15 | D | B | B (29%) |
| Example 13 | 16 | B | B | B (25%) |
| Example 14 | 17 | B | B | B (24%) |
| Example 15 | 18 | A | C | B (26%) |
| Example 16 | 19 | A | B | B (24%) |
| Comparative Example 4 | 20 | D | B | C (38%) |
| Example 17 | 21 | C | C | A (17%) |
| Example 18 | 22 | C | B | A (15%) |
| Example 19 | 23 | B | C | A (19%) |
| Example 20 | 24 | B | B | B (22%) |
| Comparative Example 5 | 25 | D | B | B (26%) |
| Example 21 | 26 | C | C | A (18%) |
| Example 22 | 27 | C | B | A (18%) |
| Example 23 | 28 | B | C | A (18%) |
| Example 24 | 29 | B | B | A (16%) |
| Comparative Example 6 | 30 | D | B | B (29%) |
| Example 25 | 31 | C | C | A (15%) |
| Example 26 | 32 | C | B | A (15%) |
| Example 27 | 33 | B | C | A (17%) |
| Example 28 | 34 | B | B | B (20%) |
| Comparative Example 7 | 35 | D | B | C (34%) |
| Example 29 | 36 | C | C | B (28%) |
| Example 30 | 37 | C | B | B (27%) |
| Example 31 | 38 | B | C | B (29%) |
| Example 32 | 39 | B | B | B (26%) |
| Comparative Example 8 | 40 | D | B | C (40%) |

It is clear from Table 2 that Example Toners according to the present invention provides images having high transparency and good fixability.

This document claims priority and contains subject matter related to Japanese Patent Applications Nos. 2009-044677 and 2009-283964, filed on Feb. 26, 2009, and Dec. 15, 2009, respectively, the entire contents of each of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner, comprising: a colorant; an amorphous polyester resin (a) consisting essentially of units from a hydroxycarboxylic acid having 2 to 6 carbon atoms; and a block copolymer (b) having (i) a block of an amorphous polyester consisting essentially of units from a hydroxycarboxylic acid having 2 to 6 carbon atoms and (ii) a block of an amorphous polyester consisting essentially of units from a diol and a dicarboxylic acid; wherein the units from the hydroxycarboxylic acid having 2 to 6 carbons of amorphous polyester resin (a) are formed from an optically-active monomer, and wherein the hydroxycarboxylic acid having 2 to 6 carbons of amorphous polyester resin (a) has an optical purity X (%) of 85% or less, the optical purity X (%) being represented by the following formula: X (%)=|X(L-isomer)−X(D-isomer); wherein X(L-isomer) and X(D-isomer) represent molar ratio (%) of L-isomer and D-isomer of the optically-active monomer, respectively.

2. The toner according to claim 1, wherein the hydroxycarboxylic acid having 2 to 6 carbons of amorphous polyester resin (a) is a lactic acid having the following formula:

$HO—C^*H(CH_3)COOH$ wherein C* represents an asymmetric carbon.

3. The toner according to claim 1, wherein the units from the hydroxycarboxylic acid having 2 to 6 carbons of amorphous polyester resin (a) are formed from a ring-opening polymerization of a mixture of a L-lactide and a D-lactide.

4. The toner according to claim 1, wherein the units from the hydroxycarboxylic acid having 2 to 6 carbons of amorphous polyester resin (a) are formed from a ring-opening polymerization of a meso-lactide.

5. The toner according to claim 1, wherein the amorphous polyester block (i) of block copolymer (b) consists essentially of a polylactic acid skeleton.

6. The toner according to claim 1, wherein the block copolymer (b) has been further reacted with a compound having 2 or more isocyanate groups.

7. The toner according to claim 1, further comprising a release agent.

8. A developer, comprising:

the toner according to claim 1; and a carrier.

9. An image forming method, comprising:

charging a surface of the electrostatic latent image bearing member;

irradiating the charged surface of the electrostatic latent image bearing member with light to form an electrostatic latent image thereon;

developing the electrostatic latent image into a toner image with the toner according to claim 1;

transferring the toner image from the electrostatic latent image bearing member onto a recording medium; and fixing the toner image on the recording medium.

* * * * *